US007762767B2

(12) United States Patent
Miyazawa et al.

(10) Patent No.: US 7,762,767 B2
(45) **Date of Patent: *Jul. 27, 2010**

(54) AXIAL-FLOW FAN

(75) Inventors: Masashi Miyazawa, Nagano (JP); Toshiki Ogawara, Nagano (JP); Tomoaki Ikeda, Nagano (JP)

(73) Assignee: Sanyo Denki Co., Ltd., Tokyo (JP)

( * ) Notice: Subject to any disclaimer, the term of this patent is extended or adjusted under 35 U.S.C. 154(b) by 543 days.

This patent is subject to a terminal disclaimer.

(21) Appl. No.: 11/563,995

(22) Filed: Nov. 28, 2006

(65) Prior Publication Data

US 2007/0122285 A1 May 31, 2007

(30) Foreign Application Priority Data

Nov. 30, 2005 (JP) ..... 2005-346879

(51) Int. Cl.
*F01D 1/02* (2006.01)

(52) U.S. Cl. ..... 415/191; 415/211.2; 415/220

(58) Field of Classification Search ..... 415/191, 415/199.5, 211.2, 220, 221
See application file for complete search history.

(56) References Cited

U.S. PATENT DOCUMENTS

| | | | | |
|---|---|---|---|---|
| 6,572,346 | B2 * | 6/2003 | Hsieh | 417/354 |
| 6,655,929 | B2 | 12/2003 | Hsieh | |
| D506,540 | S | 6/2005 | Chiu et al. | |
| 7,004,726 | B2 * | 2/2006 | Kuo | 416/247 R |
| 7,014,420 | B2 * | 3/2006 | Chang | 415/121.2 |
| 7,052,236 | B2 * | 5/2006 | Chang et al. | 415/191 |
| 7,429,162 | B2 * | 9/2008 | Lee et al. | 415/211.2 |
| 2003/0091435 | A1 * | 5/2003 | Horng et al. | 415/211.2 |
| 2004/0251000 | A1 | 12/2004 | Chang et al. | |

FOREIGN PATENT DOCUMENTS

| | | |
|---|---|---|
| CN | 2617972 | 5/2004 |
| JP | 62-070698 | 4/1987 |
| JP | 2000-110772 | 4/2000 |
| WO | 2005/003569 | 1/2005 |

* cited by examiner

*Primary Examiner*—Edward Look
*Assistant Examiner*—Ryan H Ellis
(74) *Attorney, Agent, or Firm*—Rankin, Hill & Clark LLP

(57) ABSTRACT

The present invention provides an axial-flow fan capable of entirely cooling an object to be cooled even when the distance between the object to be cooled and an air discharge opening of the axial-flow fan is short. A plurality of stationary blades 11A to 11E are disposed at intervals in a rotating direction of a rotor and located inside an air discharge opening 16 of an air channel 19. Each of the plurality of stationary blades 11A to 11E has an external end portion 11*a* connected to an inner wall portion of a fan housing 3, an internal end portion 11*b* connected to a peripheral wall portion 11B of a motor case 10, a discharge-side edge portion 11*c* formed between the external end portion 11*a* and the internal end portion 11*b* and located at a side of the air discharge opening 16, and a suction-side edge portion 11*d* formed between the external end portion 11*a* and the internal end portion 11*b* and located at a side of the air suction opening 14. An outer surface of the bottom wall portion 10A of the motor case 10 is located closer to a side of the air suction opening 14 than the discharge-side edges 11*c* of the plurality of stationary blades 11A to 11D are located.

14 Claims, 11 Drawing Sheets

Internal Inclination Angle: measured in the vicinity of the internal end portion
External Inclination Angle: measured in the vicinity of the external end portion

FIG.13

| Angle Relation | Sound Pressure Level [dB(A)] |
|---|---|
| B Internal Inclination Angle<External Inclination Angle | Na-1 |
| A Internal Inclination Angle=External Inclination Angle | Na |
| C Internal Inclination Angle>External Inclination Angle | Na+0.5 |

Internal Inclination Angle: measured in the vicinity of the internal end portion
External Inclination Angle: measured in the vicinity of the external end portion

AXIAL-FLOW FAN

FIELD OF THE INVENTION

The present invention relates to an axial-flow fan used for cooling an electric component or the like.

BACKGROUND OF THE INVENTION

FIG. 14 is a perspective view of an axial-flow fan equipped with stationary blades shown in FIG. 1 of U.S. Design Pat. No. D506,540 (Official Gazette). FIG. 15 is a rear view of a conventional axial-flow fan shown in FIG. 5 of the same U.S. Design Patent (Official Gazette). In the conventional axial-flow fan equipped with the stationary blades, edges 103 of a plurality of stationary blades 101 and a bottom surface 107 of a motor case 105 are flush with each other as shown in these figures.

In the conventional axial-flow fan, such a problem occurs that it becomes impossible to entirely cool an object to be cooled when the distance between the plurality of stationary blades and an object to be cooled is short.

SUMMARY OF THE INVENTION

An object of the present invention is to provide an axial-flow fan capable of entirely cooling an object to be cooled even when the distance between the object to be cooled and an air discharge opening of the axial-flow fan is short.

An axial-flow fan of the present invention comprises a fan housing including an air channel having an air discharge opening and an air suction opening, an impeller having a plurality of blades and disposed inside the fan housing, a rotor to which the impeller is fixed, a stator disposed corresponding to the rotor, a motor case to which the stator is fixed, and a plurality of stationary blades which connect the motor case and the fan housing. The motor case includes a bottom wall portion located at a side of the air discharge opening and a peripheral wall portion formed continuously with the bottom wall portion and extending toward the air suction opening, and the stator is fixed to the motor case. The plurality of stationary blades are disposed at intervals in the rotating direction of the rotor and located inside the air discharge opening of the air channel. Each of the plurality of stationary blades has an external end portion connected to an inner wall portion of the fan housing, an internal end portion connected to the peripheral wall portion of the motor case, a discharge-side edge portion formed between the external end portion and the internal end portion and located at a side of the air discharge opening, and a suction-side edge portion formed between the external end portion and the internal end portion and located at a side of the air suction opening.

Particularly, in the present invention, an outer surface of the bottom wall portion of the motor case is located closer to the air suction opening than edges of the discharge-side edge portions of all or most of the stationary blades are located. When one of the stationary blades is not utilized as means for receiving lead wires to supply electric power to the motor, all of the plurality of stationary blades have basically the same structure. When one of the stationary blades is utilized as means for receiving the lead wires to supply electric power to the motor, the plurality of stationary blades except for the one stationary blade (i.e., most of stationary blades) have basically the same structure.

When the above-described arrangement of the present invention is adopted, a part of air flowing along the stationary blades gets into an area above the bottom surface of the motor case, and then the air is discharged from the air discharge opening. As a result, even when the distance between an object to be cooled and the air discharge opening of the axial-flow fan is short, the air discharged from the axial-flow fan can be blown onto a part of the object to be cooled that is located opposing to the motor case of the axial-flow fan, thereby entirely cooling the object to be cooled.

The outer surface of the bottom wall portion of the motor case is composed of a flat bottom surface and an outer peripheral surface portion continuous with the flat bottom surface. It should be noted that the flat bottom surface includes not only an entirely flat surface but also a surface of which the major part is flat. For example, a bearing for supporting a rotating shaft may be disposed in the central area of the bottom surface. In this case, the outer peripheral surface portion is preferably shaped to be gradually curved from the bottom surface toward the outer peripheral surface of the peripheral wall portion. With this arrangement, the air flowing along the stationary blades toward the motor case can smoothly run onto the bottom surface of the motor case. As a result, the amount of the air, which flows from the bottom surface of the motor case toward the air discharge opening, can be increased.

Preferably, all or most of the plurality of stationary blades each include an extended portion extending on the bottom wall portion of the motor case, and the extended portion includes a guide surface for guiding a part of air flowing along the stationary blades toward the bottom surface of the bottom wall portion. With such a guide surface, the air can actively be guided onto the bottom wall portion along the guide surface.

Further, the extended portion preferably includes an extended guide surface, which is formed continuously with the guide surface and is extending toward the rotating direction. The extended guide surface helps the air flow, which has run onto the bottom wall portion of the motor case, get spirally out of the air discharge opening smoothly.

A dimensional difference in height between the bottom surface of the bottom wall portion and an edge of the discharge-side edge portion of the stationary blade may be defined as an appropriate value depending on the size and usage of the fan. An arbitrary value can be chosen. However, when the dimensional difference is defined to be 3 mm or more, the air can be discharged from an area corresponding to the bottom wall portion of the motor case without reducing the air flow and increasing the noise level even though the distance between the object to be cooled and the air discharge opening of the axial-flow fan is short.

The blade is preferably curved, in a convex manner, toward the rotating direction. Among the plurality of stationary blades, a plurality of stationary blades each having the extended portion are preferably inclined generally so that the discharge-side edge portions of the stationary blades are located more forward than the suction-side edge portions thereof in the rotating direction. The above arrangement can increase the amount of the airflow and reduce the level of generated noise.

One stationary blade among the plurality of stationary blades may have a groove portion that receives therein a plurality of lead wires for supplying electric power to the stator. In this case, the groove portion is opened toward the air discharge opening. The discharge-side edge portion of the one stationary blade is composed of two divided edges respectively located at either side of the groove portion in the rotating direction. In this case, the two divided edges may be inclined in the vicinity of the internal end portion so that the flat bottom surface of the bottom wall portion and the two divided edges are flush with each other. With this arrangement, the lead wires can easily be inserted into the groove portion.

According to the axial-flow fan of the present invention, a part of the air flowing along the stationary blades is allowed to run onto the bottom surface of the motor case and then to be discharged from the air discharge opening. Accordingly, even when the distance between the object to be cooled and the air discharge opening of the axial-flow fan is short, the air discharged from the axial-flow fan can be blown onto a part of the object to be cooled that is located opposing to the motor case of the axial-flow fan, thereby entirely cooling the object to be cooled.

BRIEF DESCRIPTION OF THE DRAWINGS

FIG. 13 is a table showing the measurement results.

DETAILED DESCRIPTION OF PREFERRED EMBODIMENTS

Figure 1:
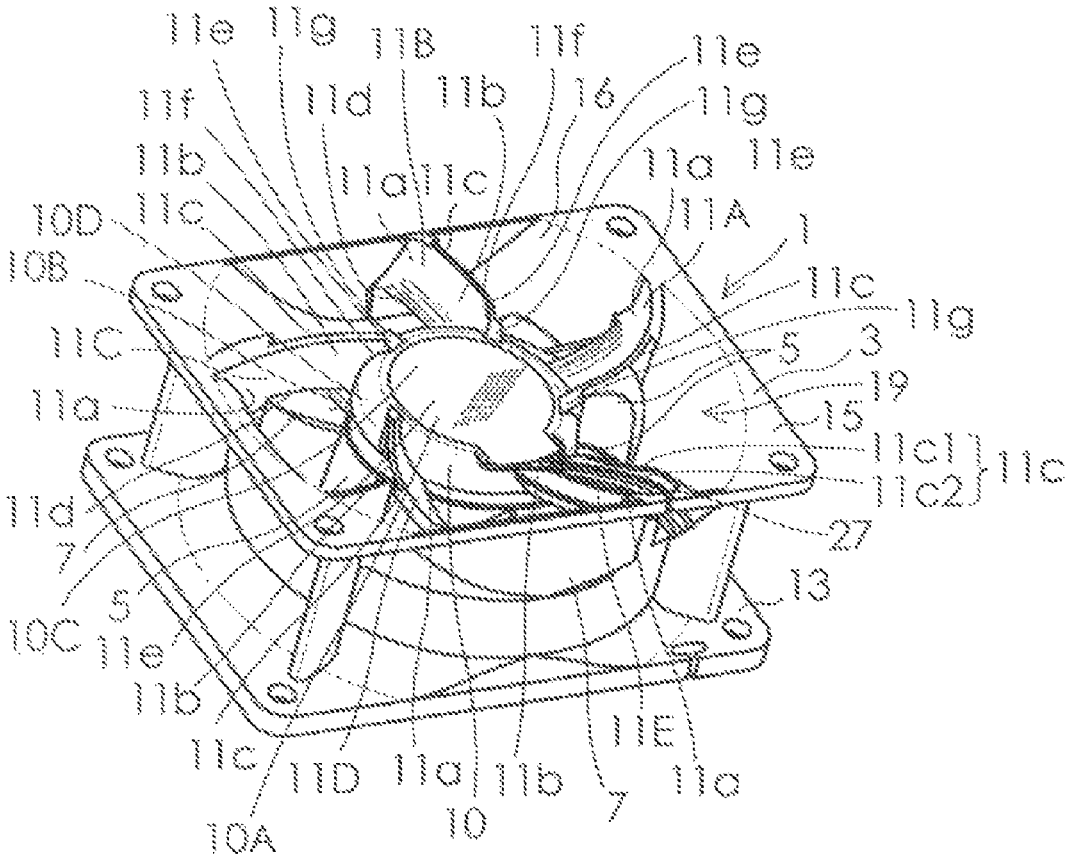
FIG. 1 is a perspective view of an axial-flow fan according to an embodiment of the present invention as viewed from the right upper front side thereof, where lead wires are omitted.
Figure 2:
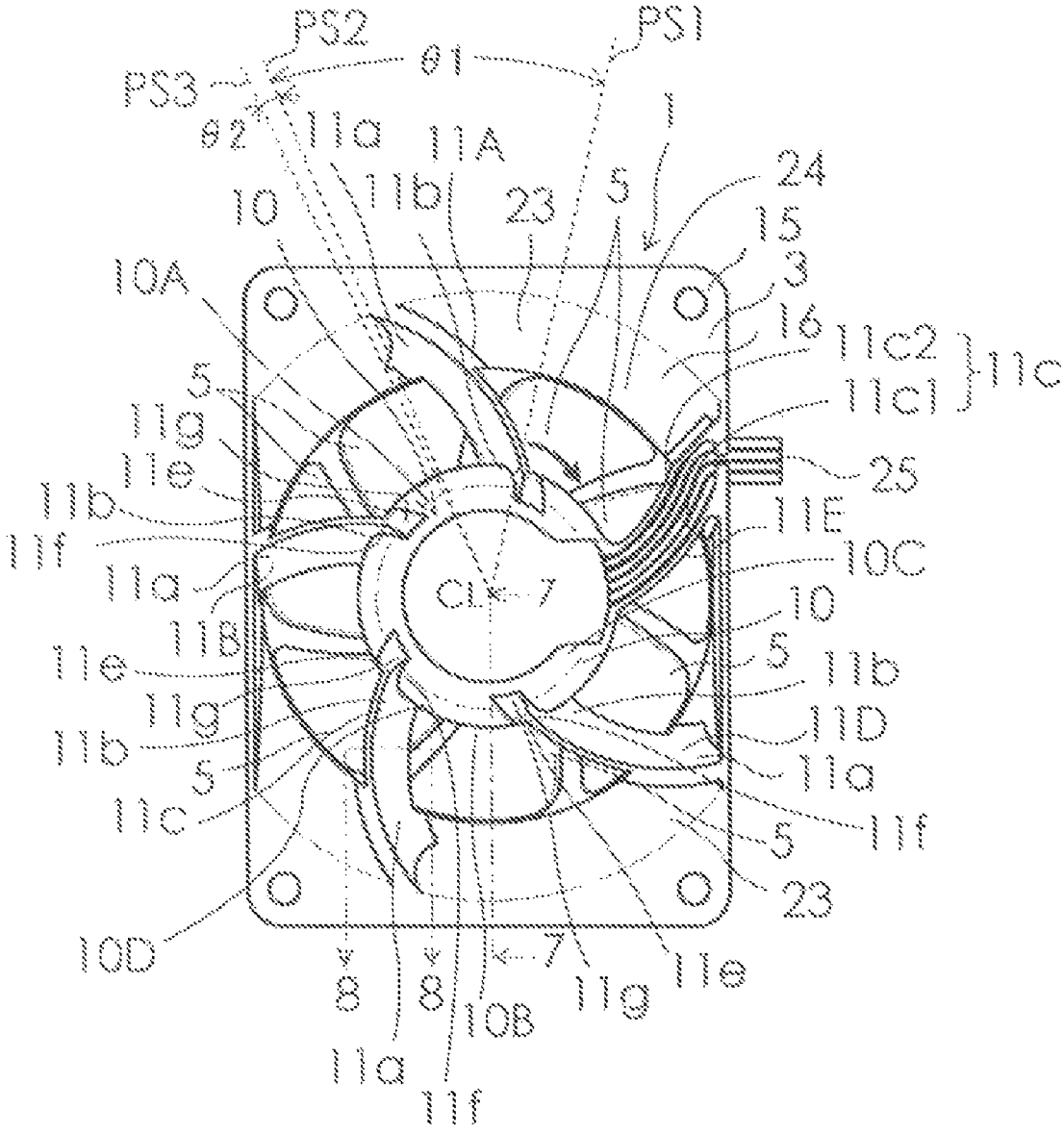
FIG. 2 is a front view of the axial-flow fan of the embodiment shown in FIG. 1.
Figure 3:
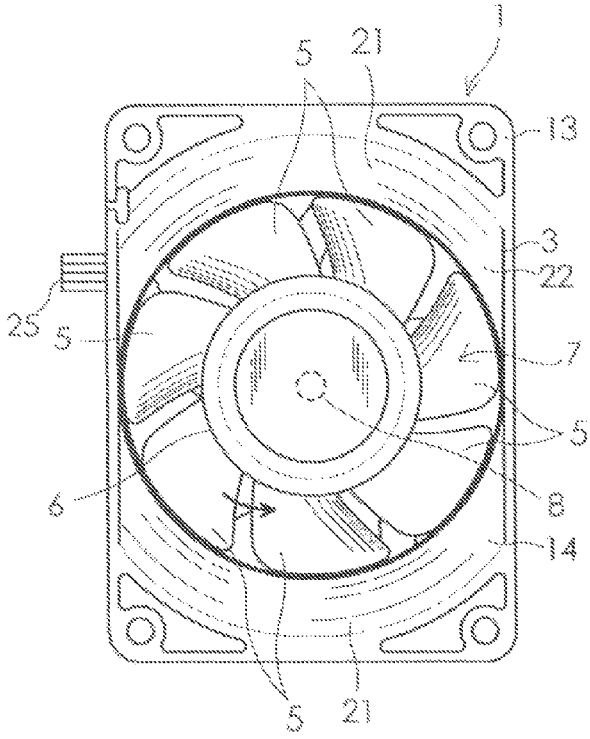
FIG. 3 is a rear view of the axial-flow fan of the embodiment shown in FIG. 1.
Figure 4:
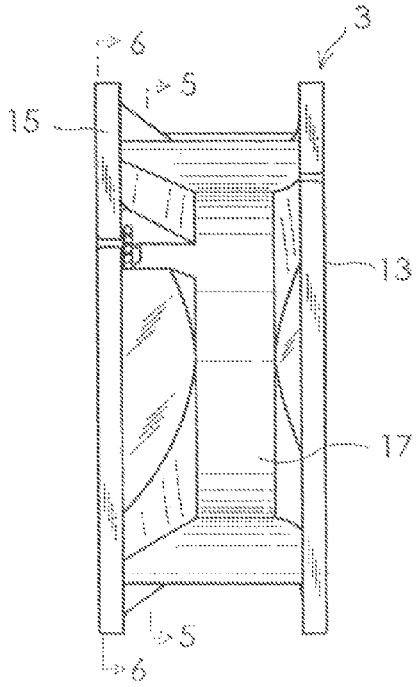
FIG. 4 is aright-side view of the axial-flow fan shown in FIG. 2.
Figure 5:
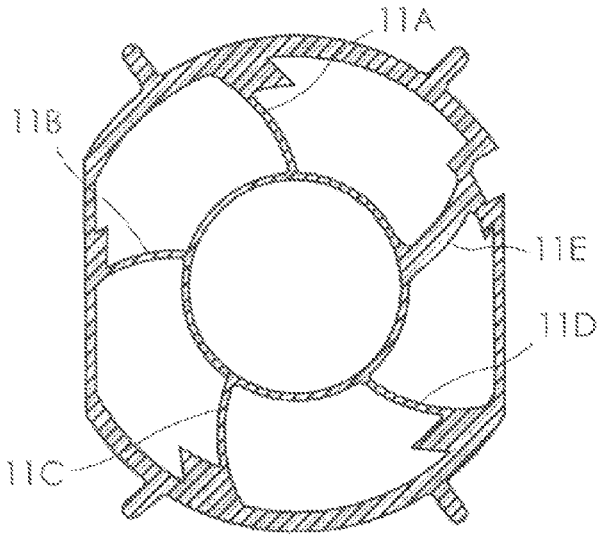
FIG. 5 is a cross-sectional view of the axial-flow fan as taken along line 5-5 in FIG. 4 where an internal structure of a motor is omitted.
Figure 6:
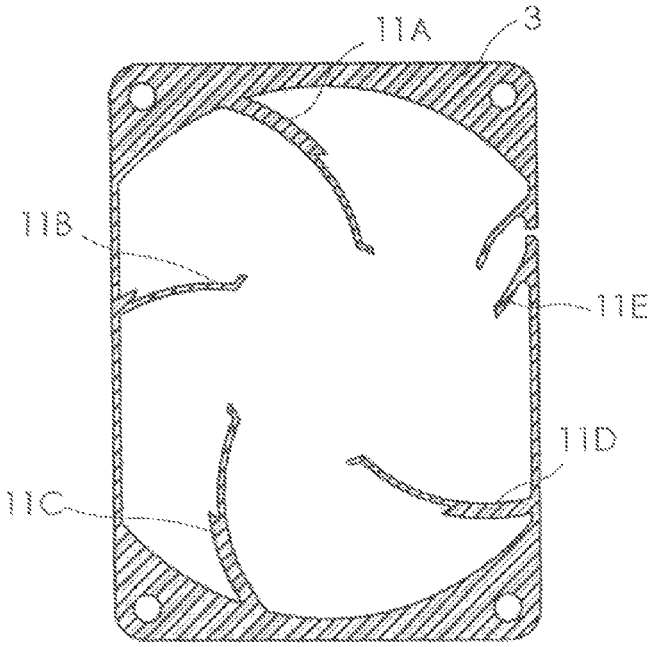
FIG. 6 is a cross-sectional view of the axial-flow fan as taken along line 6-6 in FIG. 4 where the internal structure of the motor is omitted.
Figure 7:
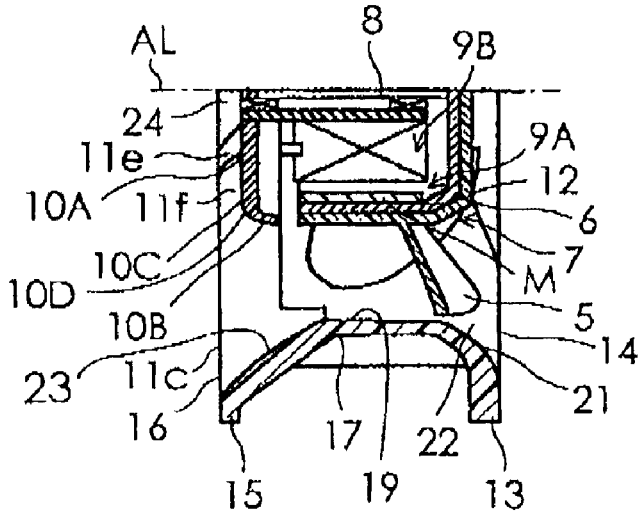
FIG. 7 is a cross-sectional view as taken along line 7-7 in FIG. 2.

An embodiment of an axial-flow fan according to the present invention will be hereinafter described in detail with reference to the accompanying drawings. FIG. 1 is a perspective view of an axial-flow fan 1 according to an embodiment of the present invention as viewed from the right upper front side thereof, where lead wires are omitted. FIG. 2 is a front view of the axial-flow fan 1 of the embodiment shown in FIG. 1, and FIG. 3 is a rear view thereof. FIG. 4 is aright-side view of the axial-flow fan 1 shown in FIG. 2. FIG. 5 is a cross-sectional view of the axial-flow fan 1 as taken along line 5-5 in FIG. 4 where an internal structure of a motor is omitted. FIG. 6 is a cross-sectional view of the axial-flow fan 1 as taken along line 6-6 in FIG. 4 where the internal structure of the motor is omitted. FIG. 7 is a cross-sectional view of the axial-flow fan as taken along line 7-7 in FIG. 2.

Referring to these figures, the axial-flow fan 1 comprises a fan housing 3 and an impeller 7 equipped with seven rotating blades 5, which is rotatably disposed inside the fan housing 3. As shown in FIG. 7, the axial-flow fan 1 further comprises a motor 9 and five stationary blades 11A to 11E. The motor 9 comprises a rotor 9A and a stator 9B. The rotor 9A is mounted with the impeller 7. In this embodiment, the rotor 9A includes a rotating shaft 8 and a plurality of permanent magnets M which are fixed onto a peripheral wall portion of a cup-shaped member 12 fixedly mounted onto the rotating shaft 8. The stator 9B includes a stator core and excitation windings wound around the stator core. The stator 9B is fixed to a motor case 10. Inside the motor case 10, a circuit board mounted with a circuit for supplying excitation current to the excitation windings is fixedly installed. The motor case 10 includes a bottom wall portion 10A located at a side of an air discharge opening 16 which will be described later, and a peripheral wall portion 10B continuously formed with the bottom wall portion 10A and extending toward an air suction opening 14 which will be described later. An outer surface of the bottom wall portion 10A of the motor case 10 is composed of a flat bottom surface 10C and an outer peripheral surface portion 10D continuous with the flat bottom surface 10C. The outer peripheral surface portion 10D is gradually curved from the bottom surface 10C toward an outer peripheral surface of the peripheral wall portion 10B.

The fan housing 3 has a suction-side flange 13 of an annular shape at one side in an extending direction of an axial line AL of the rotating shaft 8 (refer to FIG. 7) and a discharge-side flange 15 of an annular shape at the other side in the extending direction of the axial line. The fan housing 3 also includes a cylindrical portion 17 between the flanges 13 and 15. An air channel 19, which has the air suction opening 14 and the air discharge opening 16 respectively disposed at either end thereof, is an internal space formed by the suction-side flange 13, the discharge-side flange 15 and the cylindrical portion 17. A tapered surface 21 is formed inside the suction-side flange 13 as shown in FIG. 3 and FIG. 7. The tapered surface 21 is curved so that the distance between the axial line of the rotating shaft 8 and the tapered surface 21 gradually becomes larger toward the air suction opening 14. As a result, a space 22, the cross sectional area of which becomes larger toward the air suction opening 14, is formed inside the suction-side flange 13. Also, a tapered surface 23 is formed inside the discharge-side flange 15 as shown in FIG. 2 and FIG. 7. The tapered surface 23 is curved so that the distance between the axial line of the rotating shaft 8 and the tapered surface 23 gradually becomes larger toward the air discharge opening 16. As a result, a space 24, the cross sectional area of which becomes larger toward the air discharge opening 16, is formed inside the discharge-side flange 15. The suction-side flange 13 and the discharge-side flange 15 are respectively outlined in a substantially rectangular shape. A through-hole allowing a screw to pass therethrough is formed each in four corners of each of the flanges.

The impeller 7 includes a rotating blade fixing member 6 of a cup-like shape. Seven rotating blades 5 are fixed onto a peripheral wall portion of the rotating blade fixing member 6 as shown in FIG. 7. The cup-shaped member 12 is fixed inside the peripheral wall portion of the rotating blade fixing member 6, and the plurality of permanent magnets M constituting a part of the rotor of the motor 9 are fixed onto the peripheral wall of the cup-shaped member 12.

Figure 8:
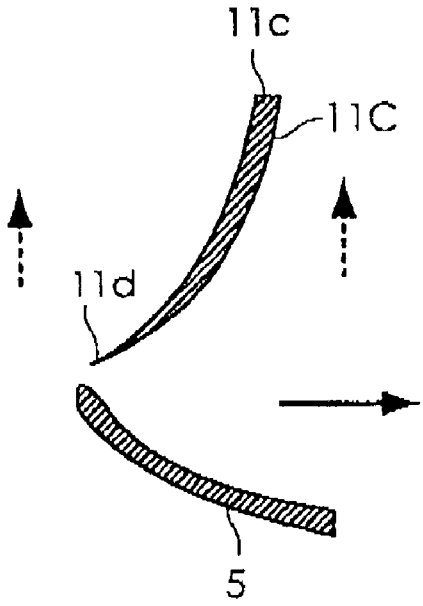
FIG. 8 illustrates cross-sectional shapes of a rotating blade and a stationary blade in order to explain the respective shapes of the rotating blade and the stationary blade.

FIG. 8 illustrates cross-sectional shapes of a rotating blade 5 and a stationary blade 11C in order to explain the respective shapes of the rotating blade 5 and the stationary blade 11A to 11D. In FIG. 8, an arrow of a solid line indicates a rotating direction of the rotating blade 5, and arrows of broken lines respectively indicate the airflow direction. FIG. 8 shows a cross-sectional view of the stationary blade 11C as taken along line 8-8 in FIG. 2. FIG. 8 also shows a cross-sectional view of the rotating blade 5 as taken in the same manner as the cross-sectional view of the stationary blade 11C. Each of the seven rotating blades 5 is curved in such a manner that a concave portion is opened toward a rotating direction of the impeller 7 as shown FIG. 8 (clockwise as viewed in FIG. 2; counterclockwise as viewed in FIG. 3). As shown in FIG. 8, the stationary blade 11C is curved in such a manner that a concave portion is opened toward a direction opposite to the rotating direction of the impeller 7 when viewed in the cross-sectional view taken along line 8-8 in FIG. 2.

Five stationary blades 11A to 11E are disposed at intervals in the rotating direction of the impeller 7 (rotor) and located inside the air discharge opening 16 of the air channel 19 as shown in FIG. 1 and FIG. 2. Each of the four stationary blades 11A to 11D has an external end portion 11*a* connected to an inner wall portion of the fan housing 3, an internal end portion 11*b* connected to the peripheral wall portion 10B of the motor case 10, a discharge-side edge portion 11*c* formed between the external end portion 11*a* and the internal end portion 11*b* and located at a side of the air discharge opening 16, and a suction-side edge portion 11*d* formed between the external end portion 11*a* and the internal end portion 11*b* and located at a side of the air suction opening 14. In this embodiment, one blade 11E of the stationary blades has a groove portion 27 that receives therein a plurality of lead wires 25 for supplying electric power to the excitation windings of the stator 9B. The groove portion 27 is opened toward the air discharge opening 16. The discharge-side edge portion 11*c* of the one stationary blade 11E is composed of two divided edges 11*c*1 and 11*c*2 respectively located at either side of the groove portion 27. The two divided edges 11*c*1 and 11*c*2 are inclined in the vicinity of the internal end portion 11*b* so that the flat bottom surface 10C of the bottom wall portion 10A of the motor case 10 and the two divided edges 11*c*1 and 11*c*2 are flush with each other. With this arrangement, the lead wires 25 can be easily inserted into the groove portion 27.

Figure 9A:
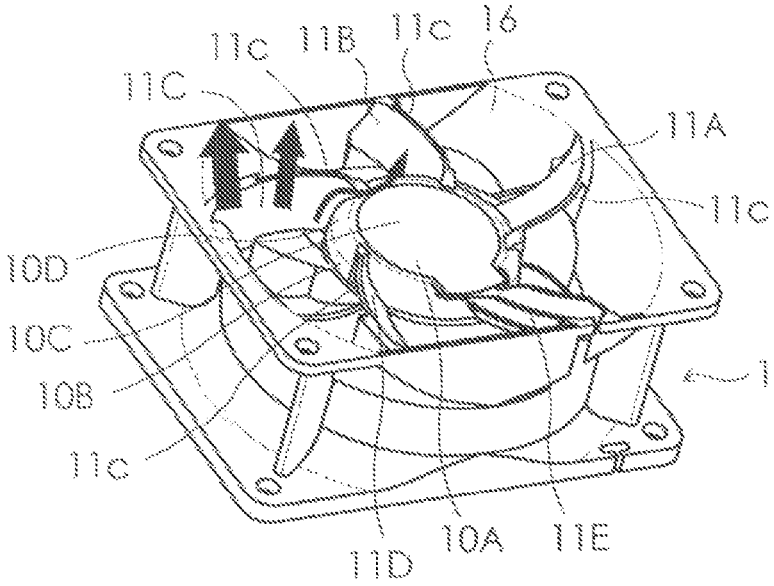
FIG. 9A is a perspective view showing airflow paths in this embodiment.
Figure 9B:
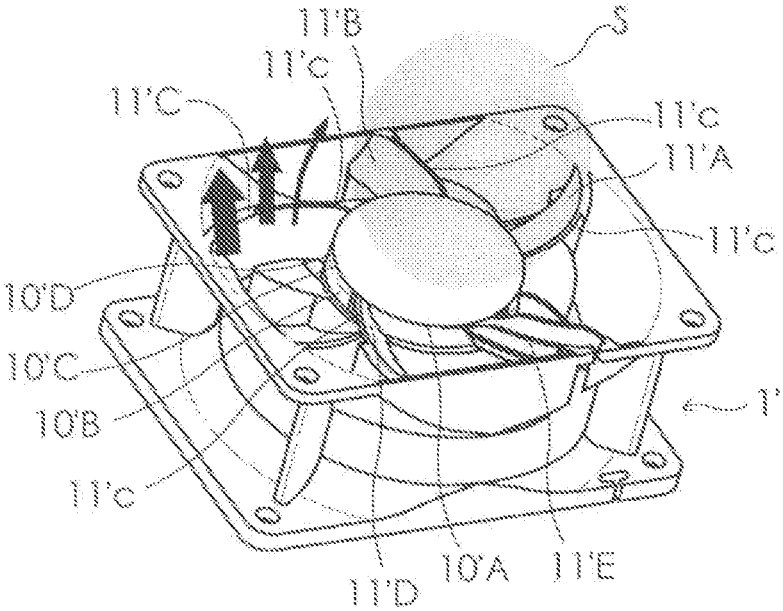
FIG. 9B is a perspective view showing airflow paths in a conventional arrangement.

In this embodiment, as shown in FIGS. 1, 2 and 7, the outer surface (bottom surface 10C) of the bottom wall portion 10A of the motor case 10 is located closer to the air suction opening 14 than the discharge-side edge portions 11*c* of the four stationary blades 11A to 11D are located. In other words, the discharge-side edge portions 11*c* of the four stationary blades 11A to 11D are located closer to the air discharge opening 16 than the outer surface (bottom surface 10C) of the bottom wall portion 10A of the motor case 10 is located. With this arrangement, a part of air flowing along the stationary blades 11A to 11E runs into an area above the bottom surface 10C of the motor case 10, and then the air is discharged from the air discharge opening 16 as shown in FIG. 9(A), in which airflow paths are indicated with arrows. As a result, even when the distance between an object to be cooled and the air discharge opening of the axial-flow fan 1 is short, the air flow discharged from the axial-flow fan can be blown onto a part of the object to be cooled that is located opposing to the motor case 10 of the axial-flow fan 1. Thus, the object to be cooled can entirely be cooled. For the purpose of comparison, FIG. 9(B) shows airflow paths when discharge-side edge portions 11*c*' of stationary blades 11A' to 11D' and the bottom surface of the bottom wall portion 10A of the motor case 10 are flush with each other; i.e., the discharge-side edge portions 11*c* and the bottom surface of the bottom wall portion 10A of the motor case 10 are located at the same height. A space S shown in FIG. 9(B) is an area where the air does not flow.

As shown in FIGS. 1, 2 and 7, each of the four stationary blades 11A to 11D is formed integrally with an extended portion 11*e* that extends on the bottom wall portion 10A of the motor case 10. Each of the extended portions 11*e* has a guide surface 11*f* for guiding a part of the air flowing along the stationary blades 11A and 11D toward the bottom surface 10C of the bottom wall portion 10A. The guide surface 11*f* extends along an outer peripheral surface portion 10D which is curved from the outer surface of the peripheral wall portion 10B of the motor case 10 toward the bottom surface 10C of the bottom wall portion 10A, and then extends on the bottom surface 10C. Such guide surface 11*f* allows the air to be actively guided onto the bottom wall portion 10C therealong. Further, the extended portion 11*e* also has an extended guide surface 11*g*, which is formed continuous with the guide surface 10*f* and extending toward the rotating direction of the impeller 7. The extended guide surface 11*g* facilitates the air, which has flown onto the bottom wall portion 10C of the motor case 10, to be smoothly flown out spirally from the air discharge opening 16. By providing the guide surface 11*f* and the extended guide surface 11*g*, a larger amount of air flows onto the bottom surface 10C of the motor case 10. Even when the guide surface 11*f* and the extended guide surface 11*g* are not provided, since the bottom surface 10C is located closer to the air suction opening than the discharge-side edges of the stationary blades 11A to 11D are located, the airflow is directed toward a central area of the motor case 10. Accordingly, compared to a conventional structure shown in FIG. 9(B), a larger amount of the air is discharged from the central area of the motor case 10.

A dimensional difference in height between the bottom surface 10C of the bottom wall portion 10A of the motor case 10 and the discharge-side edge portions 11*c* of the stationary blades 11A to 11E is preferably 3 mm or more.

Now, how to determine the shape of the stationary blades 11A to 11D will be hereinafter described, using the stationary blade 11A as an example with reference to FIG. 2. First of all, a first virtual plane PS1 is defined to extend in a radial direction, including thereon an inner end of the discharge-side edge portion 11*c* of the stationary blade 11A and a center line CL extending through the center of the rotating shaft 8. Then, a second virtual plane PS2 is defined to extend in a radial direction, including thereon an outer end of the discharge-side edge portion 11*c* of the stationary blade 11A and the center line CL. Further, a third virtual plane PS3 is defined to extend in a radial direction, including thereon an outer end of the suction-side edge portion 11*d* of the stationary blade 11A and the center line CL. Then, the shape of each stationary blade 11 is determined so that both of the directions from the first virtual plane PS1 toward the second virtual plane PS2 and from the second virtual plane PS2 toward the third virtual plane PS3 are oriented toward a direction opposite to the rotating direction of the impeller 7.

In this embodiment, the four stationary blades 11A to 11D are arranged so that the inclination angle θ4 in the vicinity of external end portion 11*a* is larger than the inclination angle θ3 in the vicinity of the internal end portion 11*b*, and that the inclination angle is gradually changed from the vicinity of the external end portion 11*a* toward the vicinity of the internal end portion 11*b*. That is, each of the stationary blades 11A to 11D is shaped as if the external end portion 11*a* is fixed and then the internal end portion 11*b* is twisted clockwise with respected to the fixed external end portion 11*a* as the external end portion 11*a* is viewed from the internal end portion 11*b*. In other words, each of the stationary blades 11A to 11D is shaped as if the internal end portion 11*b* is fixed and then the external end portion 11*a* is twisted clockwise with respect to the fixed internal end portion 11*b* as the internal end portion 11*b* is viewed from the external end portion 11*a*.

Figure 10A:
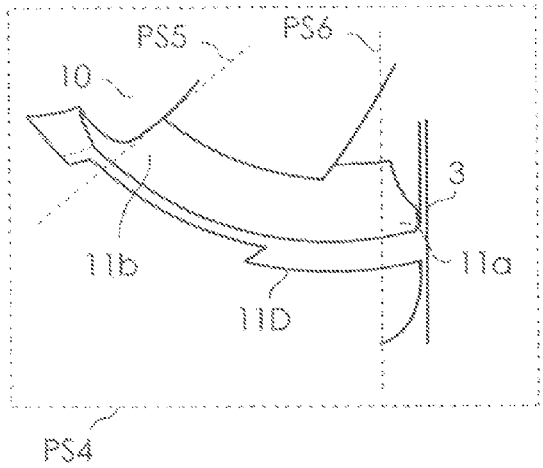
FIG. 10A is a fragmentary view of a stationary blade for illustrating an inclination angle.
Figure 10B:
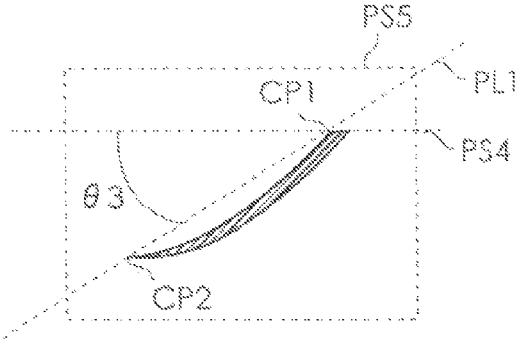
FIG. 10B is a cross-sectional view of the stationary blade as taken in the vicinity of an internal end portion.
Figure 10C:
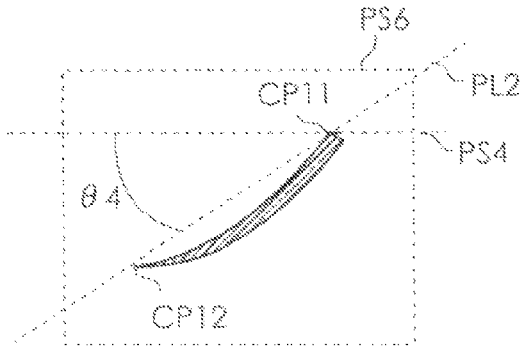
FIG. 10C is a cross-sectional view of the stationary blade as taken in the vicinity of an external end portion.

Here, the inclination angle will be described with reference with FIG. 10. FIG. 10A is a fragmentary view of a stationary blade for illustrating an inclination angle. FIG. 10B is a cross-sectional view, in which the stationary blade 11D is cut off in the vicinity of the internal end portion 11*b*, and FIG. 10C is a cross-sectional view, in which the stationary blade 11D is cut off in the vicinity of the external end portion 11*a*. First of all, a virtual plane PS4 is defined to extend along the air discharge opening 16. Then, orthogonal virtual planes PS5, PS6 are defined to be respectively orthogonal to the virtual plane PS4 and respectively orthogonal to the discharge-side edge portion 11*c* and the suction-side edge portion 11*d*. Virtual line PL1 is defined to pass through a first intersection CP1 where the orthogonal virtual plane PS5 intersects with the discharge-side edge portion 11C, and also to pass through a second intersection CP2 where the orthogonal virtual plane PS5 intersects with the suction-side edge portion 11*d*. Virtual line PL2 is defined to pass through another first intersection CP11 where the orthogonal virtual plane PS6 intersects with the discharge-side edge portion 11C, and also to pass through another second intersection CP12 where the orthogonal virtual plane PS6 intersects with the suction-side edge portion 11*d*. Then, an inclination angle is defined as an angle formed by the either of the virtual lines (PL1, PL2) and the virtual plane PS4.

FIG. 10B shows an inclination angle θ3 which is measured when the stationary blade 11D is cut off along the orthogonal virtual plane PS5 in the vicinity of the internal end portion 11*b*. FIG. 10C shows an inclination angle θ4 which is measured when the stationary blade 11D is cut off along the orthogonal virtual plane PS6 in the vicinity of the internal end portion 11*b*. As described above, in this embodiment, the inclination angle θ4 in the vicinity of the external end portion 11*a* of each of the four stationary blades 11A to 11D is larger than the inclination angle θ3 in the vicinity of the internal end portion 11*b*, and the inclination angle is gradually changed from the vicinity of the external end portion 11*a* toward the vicinity of the internal end portion 11*b*. In this embodiment, the angle of the inclination angle θ3 is preferably within a range of 45° to 55°, and the angle of the inclination angle θ4 is within a range of 50° to 60°.

The flow rate of the air discharged from the air discharge opening 16 of the axial-flow fan 1 tends to become faster in an area closer to the fan housing 3 (outer side) while the flow rate tends to become slower in an area closer to the motor case 10 (inner side). That is the reason why the stationary blades 11A to 11D are shaped as described above. This tendency is the same when stationary blades of a simpler shape are used. When the stationary blades 11A to 11D are arranged as described above, the flow rate of the air flowing in the vicinity of the internal end portions 11*b* of the stationary blades 11A to 11D is increased relative to the flow rate of the air flowing in the vicinity of the external end portions 11*a* of the stationary blades 11A to 11D. The flow rate of the air is gradually increased from the external end portions 11*a* toward the internal end portions 11*b* of the stationary blade. Based on the foregoing, it is understood that the flow rate of the air discharged from the air discharge opening 16 is generally uniformized as much as possible, thereby increasing an amount of the airflow and simultaneously reducing the noise level. In this embodiment, the rotating blade 5 has an inner side edge fixed to the rotating blade fixing member 6 and an outer side edge located more outside in the radial direction. An angle (inclination angle) formed by the inner side edge of the rotating blade 5 and an imaginary plane, which is defined to be parallel to the virtual plane PS4 and extend along a bottom wall surface of the rotating blade fixing member 6, is larger than an angle (inclination angle) formed by the imaginary plane and the outer side edge of the rotating blade 5. The difference of these inclination angles may be appropriately determined depending on a desired flow rate.

Figure 11:
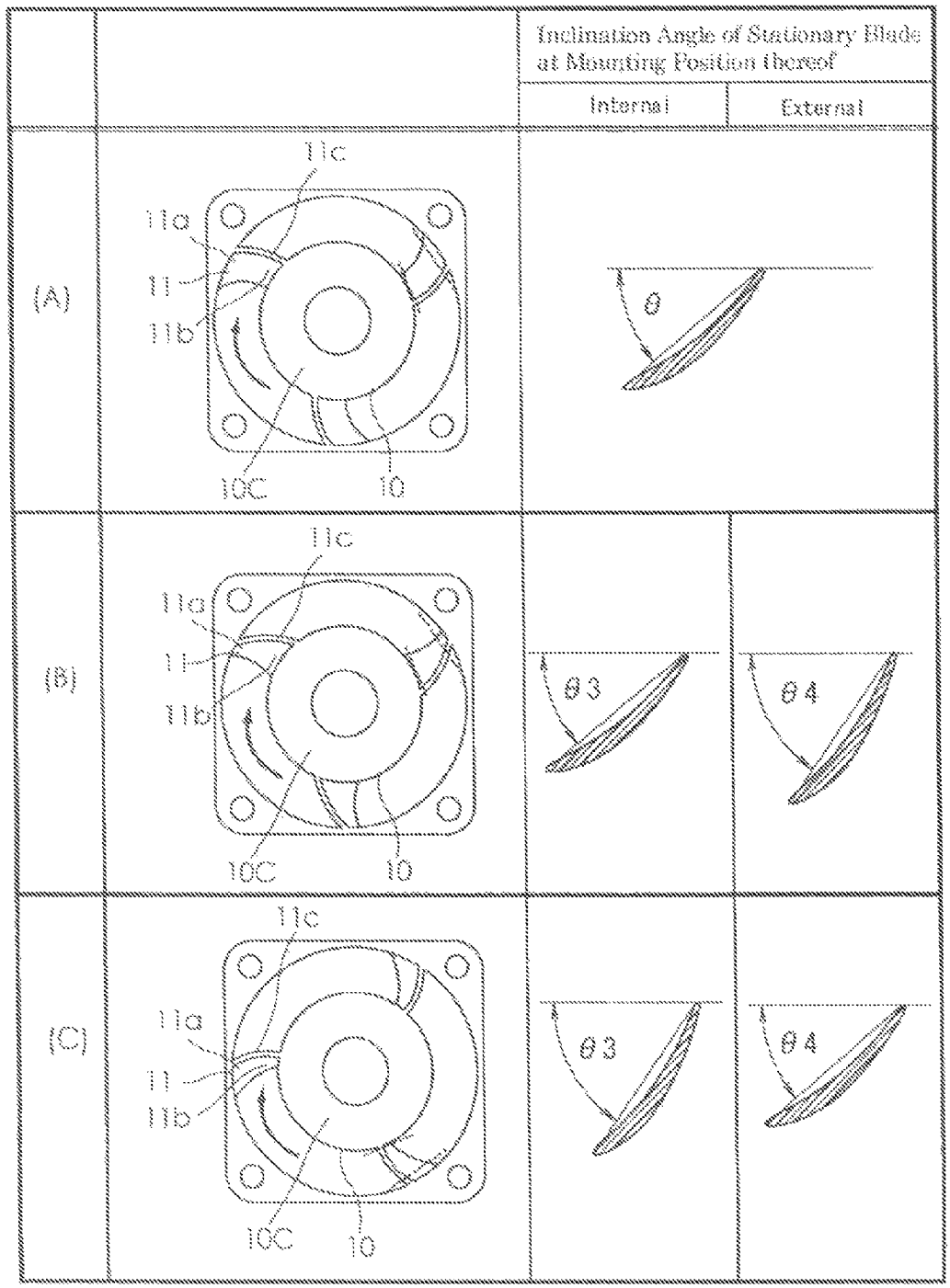
FIGS. 11A to 11C respectively show the structures and inclination angles of test axial-flow fans prepared for verifying the effects, which are obtained by defining inclination angles of the stationary blades in the vicinity of the external end portions thereof to be larger than those of the stationary blades in the vicinity of the internal end portions, and changing the inclination angle gradually from the vicinity of the external end portion toward the vicinity of the internal end portion.

FIGS. 11A to 11C respectively shows a structure and inclination angles of test axial-flow fans prepared for verifying the effects which are obtained by defining inclination angles θ4 of the stationary blades in the vicinity of the external end portions thereof to be larger than inclination angles θ3 of the stationary blades in the vicinity of the internal end portions thereof, and changing the inclination angle gradually from the vicinity of the external end portion toward the vicinity of the internal end portion. Different from the fan of the above-described embodiment, in these test fans, all the stationary blades 11 are of the same shape without using one of the blades as supporting means for the lead wires. In order to verify the effect of twisting the stationary blades, different from the embodiment, the discharge-side edge portions 11*c* of the stationary blades 11 are arranged to be flush with the bottom wall portion 10C of the motor case 10. Furthermore, each of the stationary blades 11 is not formed with the extended portion. In the fan shown in FIG. 11A, the inclination angles of the stationary blades are arranged to be constant (57°) from the internal end portion to the external end portion. In the fan shown in FIG. 11B, as with the fan of the embodiment, the inclination angle is arranged to be smaller (47°) at the side of the internal end portion of the stationary blade, the inclination angle is arranged to be larger (57°) at the side of the external end portion, and the inclination angle is arranged to gradually become larger from the internal end portion toward the external end portion. In the fan shown in FIG. 11C, the inclination angle is arranged to be larger at the side of the internal end portion of the stationary blades (57°), the inclination angle is arranged to be smaller (47°) at the side of the external end portion, and the inclination angle is arranged to gradually become smaller from the internal end portion toward the external end portion.

Figure 12:
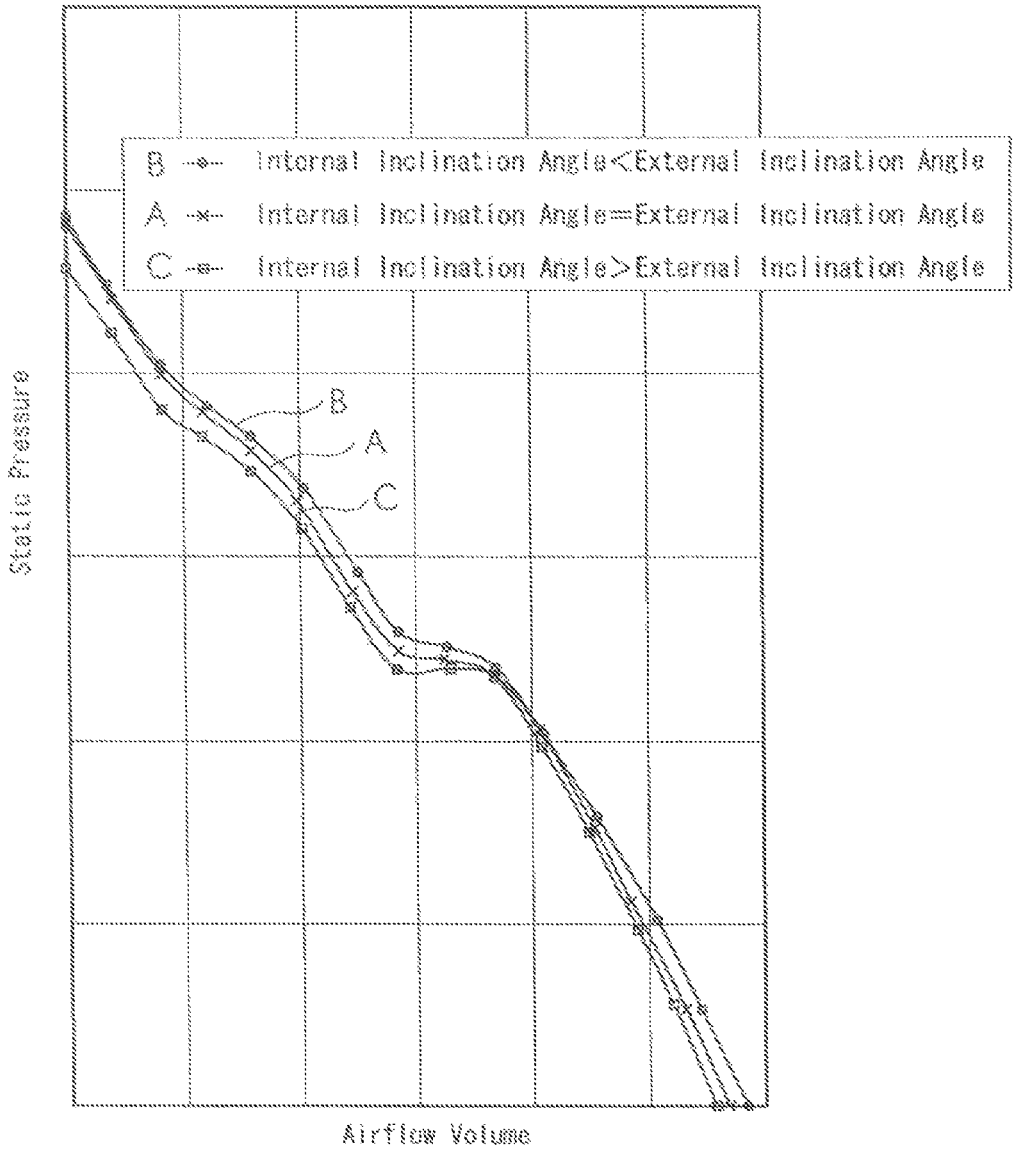
FIG. 12 is a graphical chart showing measurement results of static pressure—airflow characteristics for the three fans shown in FIGS. 11A to 11C (wherein the arrangements are the same except for the shape of the stationary blades and the number of rotations is kept constant).
Figure 14:
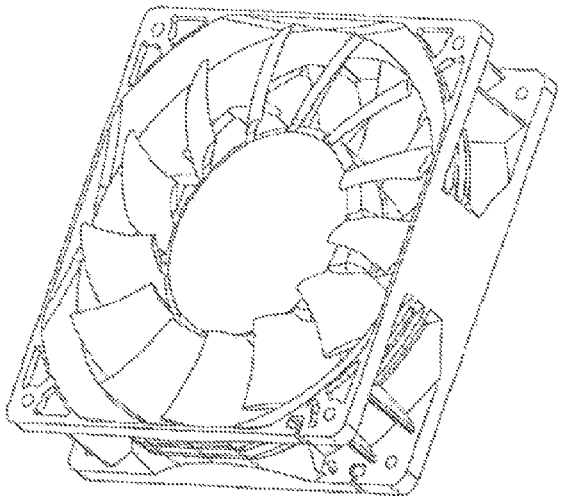
FIG.14 PRIOR ART
FIG. 14 is a perspective view of a conventional axial-flow fan.
Figure 15:
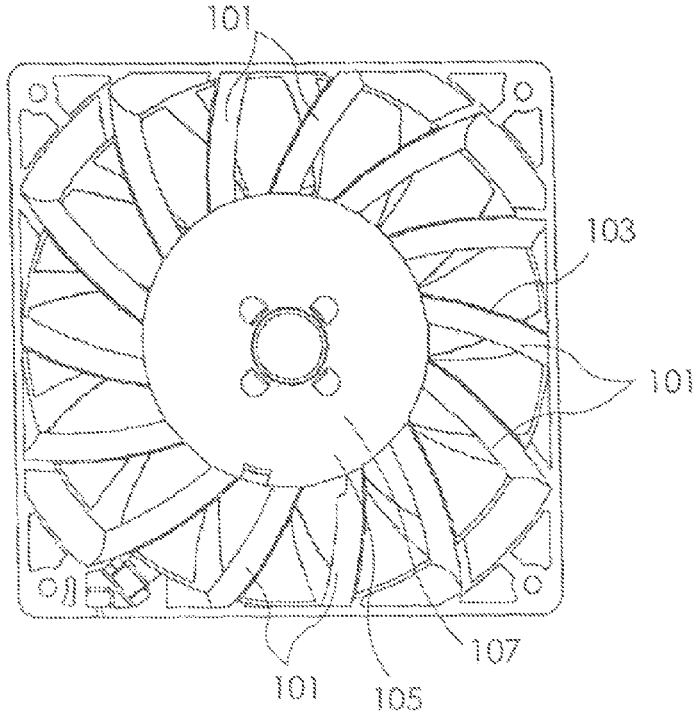
FIG.15 PRIOR ART
FIG. 15 is a rear view of the conventional axial-flow fan.

FIG. 12 is a graph chart showing measurement results of static pressure-airflow characteristics for the three fans shown in FIGS. 11A to 11C (wherein the arrangements are the same except for the shape of the stationary blades and the number of rotations is kept constant). As demonstrated in FIG. 12, in the characteristics B obtained from the fan (shown in FIG. 11B), in which the inclination angle at the side of the external end portion is larger than the inclination angle at the side of the internal end portion as with the embodiment of the preset invention, the airflow is larger than those in the characteristics A and C obtained from the other two fans (shown in FIGS. 11A and 11C) under the same static pressure.

When the measurement shown in FIG. 12 was carried out, noise was also measured simultaneously under the same conditions. Table shown in FIG. 13 shows the measurement results. Table demonstrates differences in sound pressure level with respect to the sound pressure level Na of noise, which was generated by the fan shown in FIG. 11A driven at a specific speed (the inclination angle of the stationary blades was constant). In the fan (shown in FIG. 11B) in which the inclination angle at the side of the external end portion was arranged to be larger than that of the inclination angle at the side of the internal end portion as with the above-described embodiment, the sound pressure level of the noise was decreased by 1dB (A); while in the fan (shown in FIG. 11C) in which the inclination angle at the side of the external end portion was arranged to be smaller than that of the inclination angle at the side of the internal end portion, the sound pressure level was increased by 0.5 dB (A). The measurement results demonstrate that, when the inclination angle at the side of the external end portion is arranged to be larger than the inclination angle at the side of the internal end portion as with the embodiment of the present invention, the airflow can be increased while simultaneously reducing the noise level.

In the above-described embodiment, one blade 11E of the stationary blades is constructed to receive the lead wires 25. Needless to say, however, the lead wires may simply be pulled out without adopting the arrangement shown in this embodiment.

Further, the present invention is not limited to these embodiments, but various variations and modifications may be made without departing from the scope of the present invention.

What is claimed is:

1. An axial-flow fan comprising:

a fan housing including an air channel having an air discharge opening and an air suction opening;

an impeller having a plurality of blades and disposed inside the fan housing;

a rotor to which the impeller is fixed;

a stator disposed corresponding to the rotor;

a motor case to which the stator is fixed, including a bottom wall portion located at a side of the air discharge opening and a peripheral wall portion formed continuously with the bottom wall portion and extending toward the air suction opening; and a plurality of stationary blades disposed at intervals in a rotating direction of the impeller and located inside the air discharge opening of the air channel, each of the plurality of stationary blades connecting the peripheral wall portion of the motor case and the fan housing, each of the plurality of stationary blades having an external end portion connected to an inner wall portion of the fan housing, an internal end portion connected to the peripheral wall portion of the motor case, a discharge-side edge portion formed between the external end portion and the internal end portion and located at a side of the air discharge opening, and a suction-side edge portion formed between the external end portion and the internal end portion and located at a side of the air suction opening, wherein an outer surface of the bottom wall portion of the motor case is located closer to the air suction opening than the discharge-side edge portions of all or most of stationary blades are located.

2. The axial-flow fan according to claim 1, wherein the outer surface of the bottom wall portion of the motor case is composed of a flat bottom surface and an outer peripheral surface portion continuous with the flat bottom surface, and the outer peripheral surface portion is gradually curved from the bottom surface toward an outer peripheral surface of the peripheral wall portion.

3. The axial-flow fan according to claim 1, wherein all or most of the plurality of stationary blades each include an extended portion extending on the bottom wall portion of the motor case, and the extended portion has a guide surface for guiding a part of air flowing along the stationary blades toward the bottom surface of the bottom wall portion.

4. The axial-flow fan according to claim 3, wherein the extended portion further has an extended guide surface formed continuously with the guide surface and extending toward the rotating direction.

5. The axial-flow fan according to claim 2, wherein all or most of the plurality of stationary blades each include an extended portion extending on the bottom wall portion of the motor case, and the extended portion has a guide surface for guiding a part of air flowing along the stationary blades toward the bottom surface of the bottom wall portion.

6. The axial-flow fan according to claim 5, wherein the extended portion further has an extended guide surface formed continuously with the guide surface and extending toward the rotating direction.

7. The axial-flow fan according to claim 2, wherein a dimensional difference in height between the bottom surface of the bottom wall portion and an edge of the discharge-side edge portion of the stationary blade is 3 mm or more.

8. The axial-flow fan according to claim 1, wherein the stationary blade is curved, in a convex manner, toward the rotating direction.

9. The axial-flow fan according to claim 8, wherein, among the plurality of stationary blades, a plurality of stationary blades each having an extended portion are generally inclined so that the discharge-side edge portions of the stationary blades are located more forward than the suction-side edges thereof in the rotating direction.

10. The axial-flow fan according to claim 1, wherein one stationary blade among the plurality of stationary blades has a groove portion that receives therein a plurality of lead wires for supplying electric power to the stator; the groove portion is opened toward the air discharge opening; the discharge-side edge portion of the one stationary blade is composed of two divided edges respectively located at either side of the groove portion in the rotating direction; and the two divided edges are inclined in the vicinity of the internal end portion so that the flat bottom surface of the bottom wall portion and the two divided edges are flush with each other.

11. An axial-flow fan comprising:

a fan housing including an air channel having an air discharge opening and an air suction opening;

an impeller having a plurality of blades and disposed inside the fan housing;

a rotor to which the impeller is fixed;

a stator disposed corresponding to the rotor;

a motor case to which the stator is fixed, including a bottom wall portion located at a side of the air discharge opening and a peripheral wall portion formed continuously with the bottom wall portion and extending toward the air suction opening; and a plurality of stationary blades disposed at intervals in a rotating direction of the impeller and located inside the air discharge opening of the air channel, each of the plurality of stationary blades connecting the peripheral wall portion of the motor case and the fan housing, each of the plurality of stationary blades having an external end portion connected to an inner wall portion of the fan housing, an internal end portion connected to the peripheral wall portion of the motor case, a discharge-side edge portion formed between the external end portion and the internal end portion and located at a side of the air discharge opening, and a suction-side edge portion formed between the external end portion and the internal end portion and located at a side of the air suction opening, one stationary blade among the plurality of stationary blades having a structure that receives therein a plurality of lead wires for supplying electric power to the stator, other stationary blades except for the one stationary blade being shaped so that the discharge-side edges thereof are located closer to the air discharge opening than an outer surface of the bottom wall portion of the motor case is located.

12. The axial-flow fan according to claim 11, wherein the outer surface of the bottom wall portion of the motor case is composed of a flat bottom surface and an outer peripheral surface portion continuous with the flat bottom surface, and the outer peripheral surface portion is gradually curved from the bottom surface toward an outer peripheral surface of the peripheral wall portion.

13. The axial-flow fan according to claim 12, wherein the other plurality of stationary blades each include an extended portion extending on the bottom wall portion of the motor case, and the extended portion has a guide surface for guiding a part of air flowing along the stationary blades toward the bottom surface of the bottom wall portion.

14. The axial-flow fan according to claim 13, wherein the extended portion further has an extended guide surface formed continuously with the guide surface and extending toward the rotating direction.

* * * * *